US006288686B1

(12) United States Patent
Josypenko

(10) Patent No.: US 6,288,686 B1
(45) Date of Patent: Sep. 11, 2001

(54) TAPERED DIRECT FED QUADRIFILAR HELIX ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/602,516

(22) Filed: Jun. 23, 2000

(51) Int. Cl.[7] ..... H01Q 1/36
(52) U.S. Cl. ..... 343/895
(58) Field of Search ..... 343/895, 906, 343/850, 852, 853, 860; H01Q 1/36, 11/08

(56) References Cited

U.S. PATENT DOCUMENTS 4,945,363 * 7/1990 Hoffman ..... 343/895
5,479,180 * 12/1995 Lanzing et al. ..... 343/729
5,612,707 * 3/1997 Vaughan et al. ..... 343/895
5,635,945 * 6/1997 McConnell et al. ..... 343/895
6,011,524 * 1/2000 Jervis ..... 343/895
6,088,000 * 7/2000 Ho ..... 343/770
6,094,179 * 7/2000 Davidson ..... 343/895

* cited by examiner

*Primary Examiner*—Tho Phan
(74) *Attorney, Agent, or Firm*—Michael J. McGowan; Robert W. Gauthier; Prithvi C. Lall

(57) ABSTRACT

A quadrifilar helical antenna is provided having a feedpoint for the antenna connecting to individual helical antenna elements. Each antenna element tapers from a maximum width at the feedpoint to a minimum width. The tapered antenna elements provide impedance transformation. The antenna produces a cardioid pattern that corresponds to antennas with constant width antenna elements.

19 Claims, 9 Drawing Sheets

TAPERED DIRECT FED QUADRIFILAR HELIX ANTENNA

CROSS REFERENCE TO RELATED APPLICATION

This patent application is co-pending with a related patent application entitled HELIX ANTENNA (Ser. No. 09/356,803) filed on Jul. 19, 1999 by the inventor hereof and assigned to the assignee hereof is incorporated herein by reference.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to antennas and more specifically to quadrifilar antennas.

(2) Description of the Prior Art

Numerous communication networks utilize omnidirectional antenna systems to establish communications between various stations in the network. In some networks one or more stations may be mobile while others may be fixed land-based or satellite stations. Omnidirectional antenna systems are preferred in such applications because alternative highly directional antenna systems become difficult to apply, particularly at a mobile station that may communicate with both fixed land-based and satellite stations. In such applications it is desirable to provide an omnidirectional antenna system that is compact yet characterized by a wide bandwidth and a good front-to-back ratio with either horizontal or vertical polarization.

Some prior art omnidirectional antenna systems use an end fed quadrifilar helix antenna for satellite communication and a co-mounted dipole antenna for land based communications. However, each antenna has a limited bandwidth. Collectively their performance can be dependent upon antenna position relative to a ground plane. The dipole antenna has no front-to-back ratio and thus its performance can be severely degraded by heavy reflections when the antenna is mounted on a ship, particularly over low elevation angles. These co-mounted antennas also have spatial requirements that can limit their use in confined areas aboard ships or similar mobile stations.

The following patents disclose helical antennas that exhibit some, but not all, the previously described desirable characteristics:

U.S. Pat. No. 4,295,144 (1981) Matta et al.

U.S. Pat. No. 5,170,176 (1992) Yasunaga et al.

U.S. Pat. No. 5,198,831 (1993) Burrell et al.

U.S. Pat. No. 5,255,005 (1993) Terret et al.

U.S. Pat. No. 5,343,173 (1994) Balodis et al.

U.S. Pat. No. 5,635,945 (1997) McConnell

U.S. Pat. No. 5,793,173 (1998) Standke et al.

U.S. Pat. No. 4,295,144 to Matta et al. discloses a feed system for a helical CP antenna that features folded belt or phasing lines to reduce space and icing and wind loading problems. If two belt lines are used, they can be placed diametrically opposite each other to reduce mutual coupling.

In U.S. Pat. No. 5,170,176 (1992) to Yasunaga et al. a quadrifilar helix antenna includes four helix conductors wound around an axis in the same winding direction. Each helix conductor has a linear conductor which is parallel to its axis at either end or both ends of the helix conductor. The purpose of this structure is to reduce the effect of multipath fading due to sea-surface reflection in mobile satellite communications. Although this patent discloses an antenna that provides good front-to-back ratio, the transmission pattern from the antenna is also characterized by essentially forming two major lobes about 60° from the forward direction so it is not truly omni-directional over a hemisphere.

U.S. Pat. No. 5,198,831 to Burrell et al. discloses a navigation unit for receiving navigation signals from a source, such as global positioning satellites. A directly mounted helical antenna includes antenna elements composed of a thin film of conductive material printed on a flexible dielectric substrate rolled into a tubular configuration.

In U.S. Pat. No. 5,255,005 to Terret et al., an antenna structure for L band communications has a quasi-hemispherical radiation pattern and is capable of having a relatively wide passband, so that it is possible to define two neighboring transmission sub-bands therein or, again, a single wide transmission band. The antenna is of the type comprising a quadrifilar helix formed by two bifilar helices positioned orthogonally and excited in phase quadrature, and including at least one second quadrifilar helix that is coaxial and electromagnetically coupled with said first quadrifilar helix.

U.S. Pat. No. 5,343,173 to Balodis et al. discloses a method of and apparatus for transmitting or receiving circularly polarized signals. The technique employs a phase shifting network for connection between an antenna and a radio transmitter or receiver to produce a phase shift when transmitting or to eliminate a phase shift when receiving. In one preferred embodiment, a dielectric substrate has a phase shifting network or printed circuit lines defining signal transmission paths between a radio connection terminal and a plurality of antenna element connection terminals for coupling a multi-element antenna and a radio. Each transmission path is phase shifted relative to an adjacent path by a predetermined amount by each path having progressively equally different electrical length to provide equal phase shift of a radio frequency signal progressively through the transmission paths. Adjacent path pairs are progressively joined at combiner nodes of equal power division by shunt connection line segments so that the power at each antenna connection terminal is equal to the power at the radio connection terminal divided by the number (typically four) of antenna terminals.

U.S. Pat. No. 5,635,945 (1997) to McConnell et al. discloses a quadrifilar helix antenna with four conductive elements arranged to define two separate helically twisted loops, one differing slightly in electrical length from the other. The two separate helically twisted loops are connected to each other in a way as to provide impedance matching, electrical phasing, coupling and power distribution for the antenna. The antenna is fed at a tap point on one of the conductive elements determined by an impedance matching network which connects the antenna to a transmission line. This patent utilizes microstrip techniques to feed and match through a partly balanced transmission line. As a result the resultant bandwidth is narrow.

U.S. Pat. No. 5,793,338 to Standke et al. discloses a quadrifilar antenna comprising four radiators which, in the preferred embodiment, are etched onto a radiator portion of a microstrip substrate. The microstrip substrate is formed into a cylindrical shape such that the radiators are helically wound. A feed network etched onto the microstrip substrate feed network provides 0°, 90°, 180° and 270° phase signals to the antenna radiators. The feed network utilizes a combination of one or more branch line couplers and one or more power dividers to accept an input signal from a transmitter and to provide therefrom the 0°, 90°, 180° and 270° signals needed to drive the antenna.

There exists a family of quadrifilar helixes that are broadband impedance wise above a certain "cut-in" frequency, and thus are useful for wideband satellite communications including Demand Assigned Multiple Access (DAMA) UHF functions in the range of 240 to 320 MHz and for other satelite communications functions in the range of 320 to 410 MHz. Typically these antennas have (1) a pitch angle of the elements on the helix cylindrical surface from 50 down to roughly 20 degrees, (2) elements that are at least roughly ¾ wavelengths long, and (3) a "cut-in" frequency roughly corresponing to a frequency at which a wavelength is twice the length of one turn of the antenna element. This dependence changes with pitch angle. Above the "cut-in" frequency, the helix has an approximataely flat VSWR around 2:1 or less (about the $Z_o$ value of the antenna). Thus the antenna is broadband impedance-wise above the cut-in frequency. The previous three dimensions translate into a helix diameter of 0.1 to 0.2 wavelengths at the cut-in frequency.

For pitch angles of approximately 30 to 50°, such antennas provide good cardioid shaped patterns for satellite communications. Good circular polarization exists down to the horizon since the antenna is greater than 1.5 wavelengths long (2 elements constitute one array of the dual array, quadrifilar antenna) and is at least one turn. At the cut-in frequency, lower angled helixes have sharper patterns. As frequency increases, patterns start to flatten overhead and spread out near the horizon. For a given satellite band to be covered, a tradeoff can be chosen on how sharp the pattern is allowed to be at the bottom of the band and how much it can be spread out by the time the top of the band is reached. This tradeoff is made by choosing where the band should start relative to the cut-in frequency and the pitch angle.

For optimum front-to-back ratio performance, the bottom of the band should start at the cut-in frequency. This is because, for a given element thickness, backside radiation increases with frequency (the front-to-back ratio decreases with frequency). This decrease of front-to-back ratio with frequency limits the antenna immunity to multipath nulling effects.

My above-identified pending United States Letters Patent (Ser. No. 09/356,803) discloses an antenna having four constant-width antenna elements wrapped about the periphery of a cylindrical support. This construction provides a broadband antenna with a bandwidth of 240 MHz to at least 400 MHz and with an input impedance in a normal range, e.g., 100 ohms. This antenna also exhibits a good front-to-back ratio in both open-ended and shorted configurations. In this antenna, each antenna element has a width corresponding to about 95% of the available width for that element. However, it has been found that such wide elements increase backside radiation and therefor degrade an idealized front-to-back ratio. In addition, the weight of the antenna elements at such widths approaches maximum limits in many applications, particularly satellite applications. What is needed is a wideband antenna that provides good cardioid patterns with circular polarization, a good front-to-back ratio and a construction that minimizes the weight of the antenna elements.

SUMMARY OF THE INVENTION

Therefore it is an object of this invention to provide a broad band unidirectional hemispherical coverage antenna.

Another object of this invention is to provide a broad band unidirectional hemispherical coverage antenna with good front-to-back ratio.

Yet another object of this invention is to provide a broad band unidirectional hemispherical coverage antenna that operates with circular polarization.

Yet still another object of this invention is to provide a broad band unidirectional hemispherical coverage antenna that operates with a circular polarization and that exhibits a good front-to-back ratio.

Yet still another object of this invention is to provide a broad band unidirectional hemispherical coverage antenna that is simple to construct and is lightweight.

In accordance with one aspect of this invention, a helical antenna for an input rf signal includes a cylindrical support and a given plurality of antenna elements wrapped on the cylindrical support as spaced helices along an antenna axis between first and second ends. Each antenna element has a maximum cross sectional area at the first end and a reduced cross sectional area at the second end.

In accordance with another aspect of this invention, a quadrifilar helical antenna for operating over a frequency bandwidth defined by a minimum operating frequency comprises a cylindrical support extending along an antenna axis between first and second ends thereof and four equiangularly spaced helical antenna elements extending along said support between the first and second ends. Each antenna element has a length of at least ¾ wavelength at a minimum antenna operating frequency, a constant thickness, a maximum width at the first end and a minimum width at the second end.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
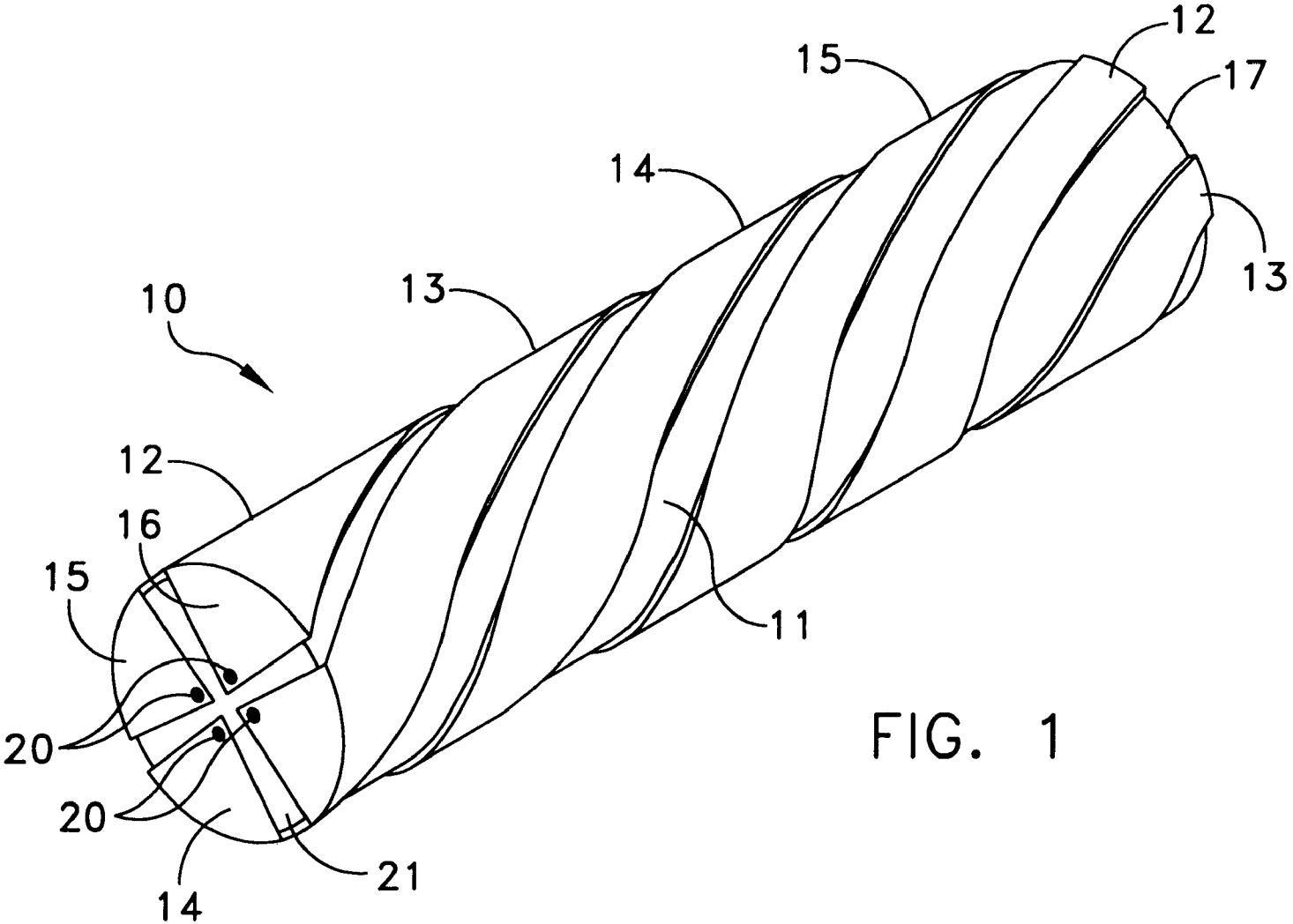
FIG. 1 is a perspective view of one embodiment of a quadrifilar helix antenna constructed in accordance with this invention.
Figure 2:
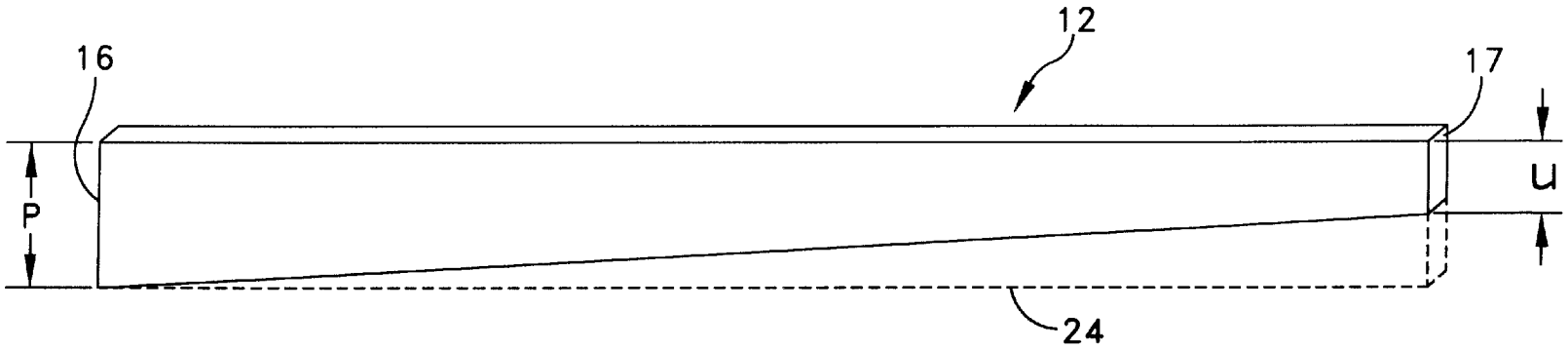
FIG. 2 is a perspective view one of the antenna elements in an unwrapped state.

In FIG. 1, a quadrifilar helix antenna 10, constructed in accordance with this invention, includes a cylindrical insulated core 11. Four antenna elements, 12, 13, 14 and 15, wrap helically about the core 11 and extend from a feed or first end 16 to a second end 17. FIG. 2 depicts the antenna element 12 prior to wrapping. It has a maximum width or cross sectional area at its feed or first end 16 and a minimum width or cross sectional area at its second end 17. In this particular embodiment, the width of the antenna element 12 tapers linearly from the first end 16 to the second end 17. The antenna element 12 has a constant thickness. Referring again to FIG. 1, the antenna element 12 and identical antenna elements 13, 14, and 15 are wrapped as spaced helices about the core 11.

Still referring to FIG. 1, a plurality of feedpoints 20 at the first end 16 provide a series of conductive paths that extend centrally on an end support 21 to each of the helically wrapped elements 12 through 15. The signals applied to these feedpoints are in phase quadrature. In one form, an RF signal at an rf frequency is applied to a 90° power splitter with a dump port terminated in a characteristic impedance, $Z_o$. The two outputs of the 90° power splitter connect to the inputs of two 180° degree power splitters thereby to provide the quadrature phase relationship among the signals on adjacent ones of the antenna elements 12 through 15. It is known that swapping the output cables of the 90° power splitter will cause the antenna to transfer between backfire and forward radiation modes.

As also known, a transmission line section having a minimum length of one-half wavelength (i.e., 0.5λ) will match two different values of resistance or two different transmission lines of different characteristic impedances over a broad frequency band. One resistance or transmission line is placed on one side of the section; the other is placed on the other side of the section. When matching these transmission lines, the width of the conductors at the ends of the section are the same as the transmission lines. Along the length of the section the conductor width tapers according to some function from the width at one end of the section to the width at the other end of the section. The simplest, but not necessarily optimal, taper is a linear taper.

With this background, the quadrifilar helix antenna 10 in FIG. 1 can be looked upon as two intertwined lossy transmission lines with antenna elements 12 and 14 forming one transmission line and antenna elements 13 and 15, the other transmission line. The impedance locus of each pair is similar to that of a lossy transmission line. Consequently, part of the helix itself can be used to match a section of wide element through and to a section of narrow element. In the particular embodiment of FIGS. 1 and 2, the wide edge at first end 16 has a dimension P; the narrow edge the second end 17, a dimension u. The taper is linear. To achieve an antenna with a 100 ohm input impedance, P is approximately 0.95 of the maximum potential width for the element.

Figure 3:
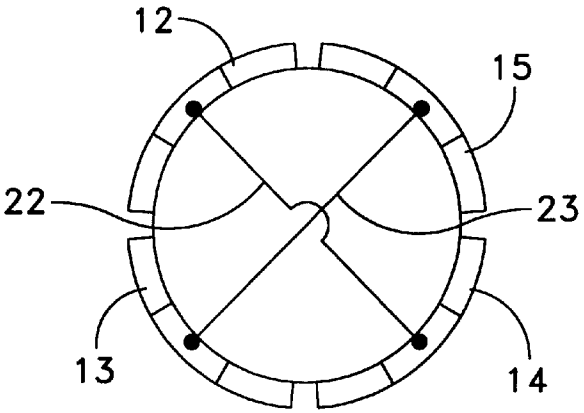
FIG. 3 is an end view of the antenna shown in FIG. 2.

There are two criteria that must be met if the antenna is to be useful. First, the low input impedance of the standard antenna, as discussed in the above identified United States Letters Patent (Ser. No. 09/356,803) must be maintained. Secondly, the cardioid pattern achieved by that standard antenna must also be maintained. An antenna modeling program proves the maintenance of the input impedance. An antenna was operated in a forward fire mode with the second or unfed ends of the antennas elements terminated at open ends as opposed to shorted ends, such as shown in FIG. 3 in which a conductor 22 shorts elements 12 and 14 and a conductor 23 shorts elements 13 and 15.

Figure 4:
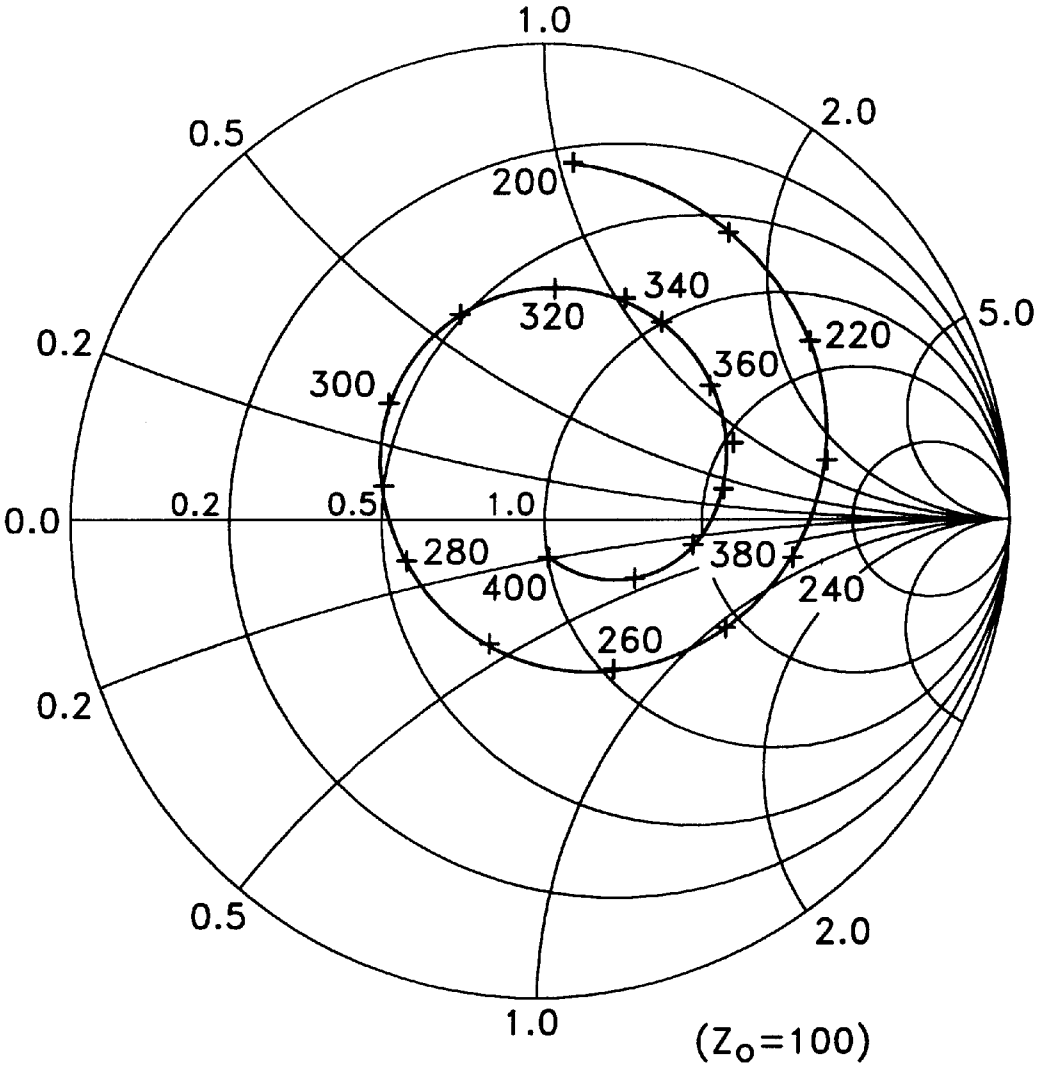
FIGS. 4, 5 and 6 are Smith charts for depicting calculated antenna impedances.
Figure 5:
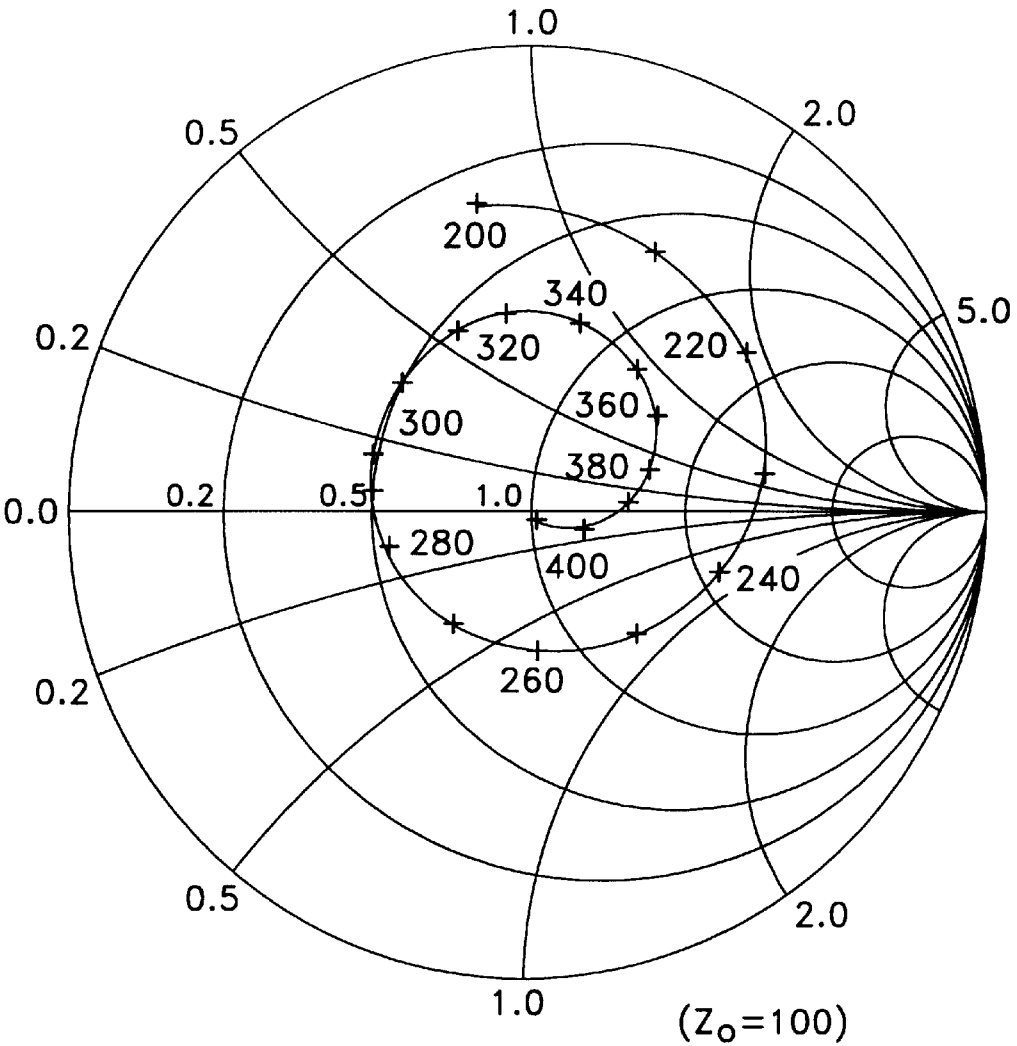
Figure 6:
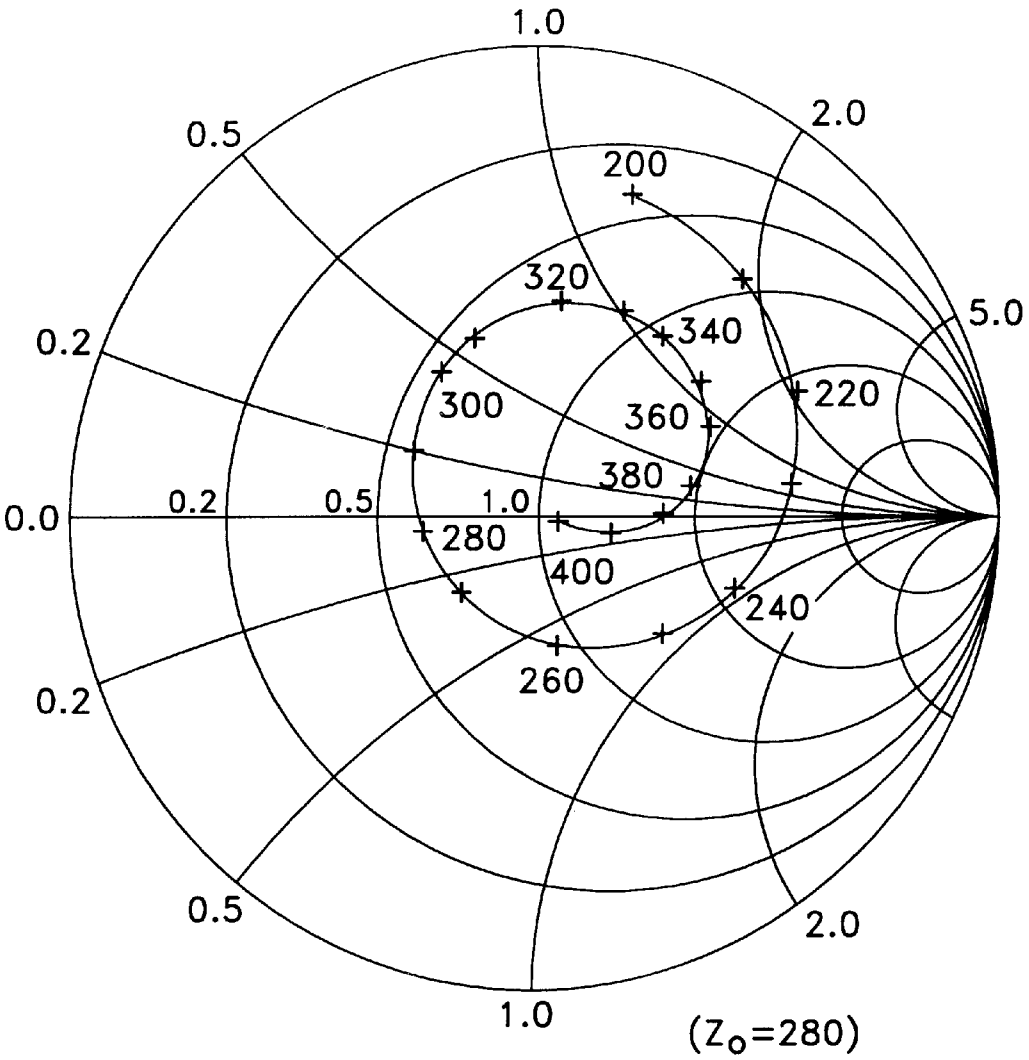

The core support in the standard antenna and the modeled antenna was 9" in diameter and 30.5" long. For the standard antenna, constant width, flat wires, or more precisely, flat metal sheets, were wrapped helically at a 40° C. pitch. FIG. 4 depicts the normalized input impedance for the standard antenna. FIG. 5 is a Smith chart of an antenna in which the antenna elements tapered from the first end to the second end over a ratio of 10:1. A reverse taper in which the wire elements tapered outwardly from the first end to the second end by a ratio of 1:10 produced the Smith chart of FIG. 6. It can be seen that above a cut-in frequency, the VSWR about the $Z_o$ of the antennas at their feed ends is approximately the same. In all three cases, the $Z_o$ at the feed end is the $Z_o$ of the transmission line at the feed end. Tapering the elements allows the $Z_o$ along the element to change smoothly from one end to the other without disturbing the VSWR of the antenna. So it can be stated that the characteristic impedance of the standard antenna is maintained with tapering.

Figure 7A:
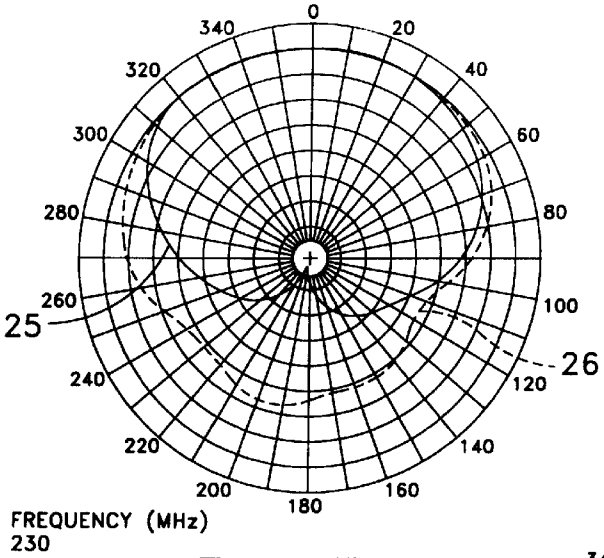
FIGS. 7A through 7C depict gain comparisons between the embodiment of FIGS. 1 and 2 and a standard antenna.
Figure 7B:
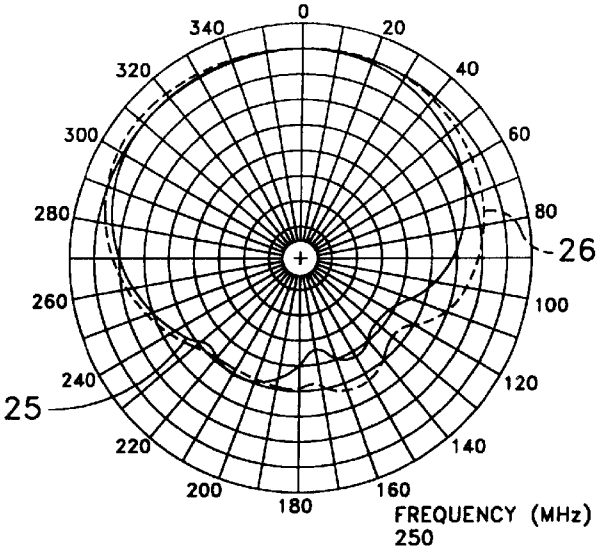
Figure 7C:
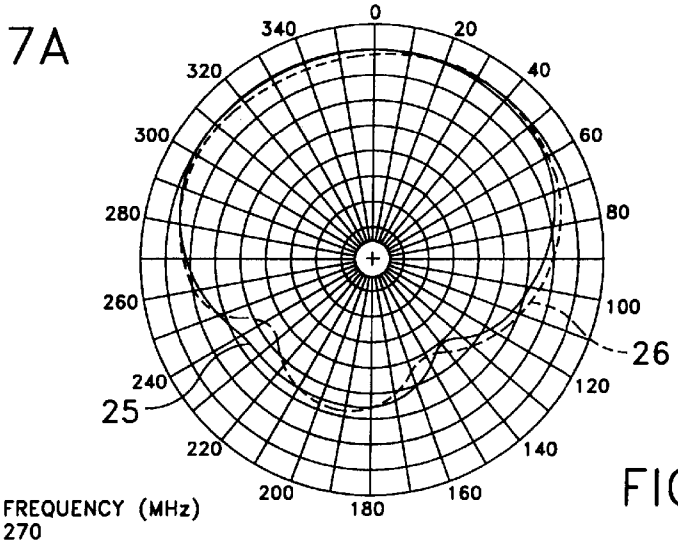

The antenna of FIG. 1 also meets the criteria requiring the maintenance of cardioid patterns. FIGS. 7A through 7C depict the cardioid patterns for a standard antenna (solid lines 25) and the antenna of FIG. 1 (dashed lines 26) which were constructed to operate in an open-circuit, backfire mode. Each was formed on a core having a cylinder diameter of 9" and length of 30.5". Each antenna element was formed of a copper strip having a width at the first end 16 of 4.05" (i.e., P=4.05"). Each element had a length of 47.5" corresponding to a wavelength at 249 MHz with a pitch angle of 40°. The standard model used a constant width antenna element shown in phantom in FIG. 2 by reference numeral 24. The width is 4.05". In the model of FIG. 1, the antenna element 12 tapers to a width of two inches (i.e., u=2").

Referring again to FIGS. 7A through 7C, at 230 MHz the forward gain distribution is essentially the same, but the front to back ratio is slightly worse with the tapered construction of FIG. 1. At 250 MHz, the front to back ratios on average, are the same. At 270 MHz and at higher frequencies up to 340 MHz that the patterns are essentially identical between the tapered antenna of FIG. 1 and the standard antenna.

Figure 8:
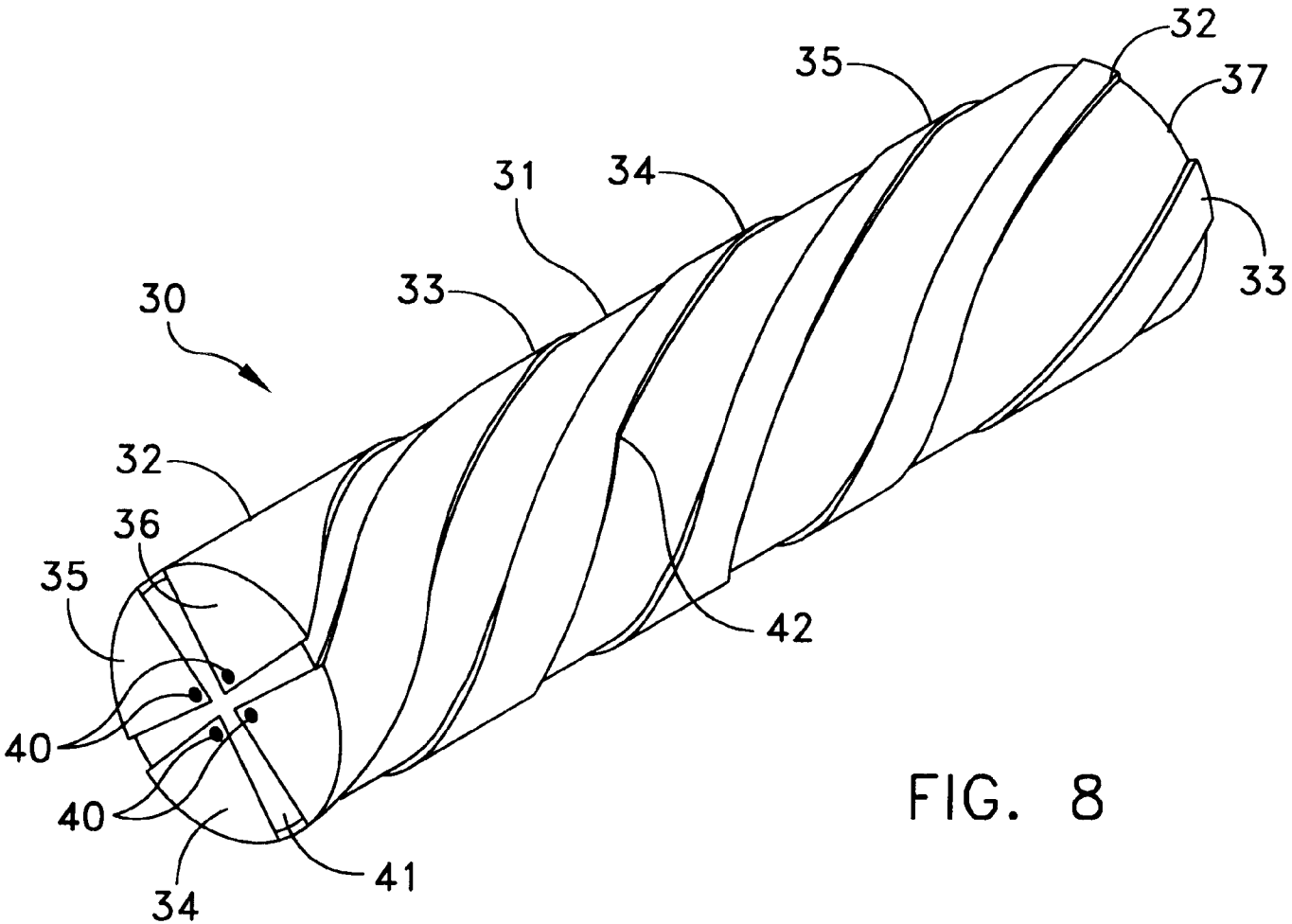
FIG. 8 is perspective view of a second embodiment of this invention.
Figure 9:
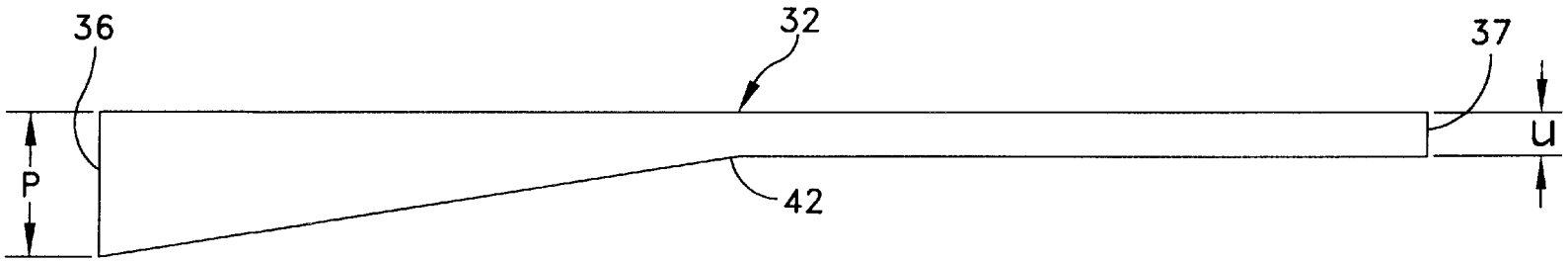
FIG. 9 is a perspective view of one of the antenna elements in the embodiment of FIG. 8 in an unwrapped state.

Another antenna embodiment shown in FIGS. 8 and 9 depicts an alternate tapering implementation. In this embodiment an antenna 30 has a cylindrical core support 31 that carries antenna elements 32, 33, 34 and 35 from a first end 36 to a second end 37. A similar feed arrangement comprising feedpoints 40 on an end support 41 provides a series of four antenna feedpoints for receiving quadrature phase signals. In this particular embodiment, each antenna element has the same structure as shown in FIG. 9. As in the embodiment of FIG. 1, each antenna element will generally be formed with a constant thickness. In this embodiment, like the embodiment in FIG. 1, at the first end 36 the antenna element has a maximum width P and cross sectional area and a reduced width and cross sectional area at the second end 37. However, in this embodiment of FIG. 9, the width tapers to a minimum cross sectional area at a point 42 intermediate the ends 36 and 37. The distance from the first end 36 to the point 42 is 0.5 wavelengths at the cut-in frequency. From the point 42 to the second end 37 the antenna element has a constant width and u=0.75". 30 has a cylindrical core support 31 that carries antenna elements 32, 33, 34 and 35 from a first end 36 to a second end 37. A similar feed arrangement comprising feedpoints 40 on an end support 41 provides a series of four antenna feedpoints for receiving quadrature phase signals. In this particular embodiment, each antenna element has the same structure as shown in FIG. 9. As in the embodiment of FIG. 1, each antenna element will generally be formed with a constant thickness. In this embodiment, like the embodiment in FIG. 1, at the first end 36 the antenna element has a maximum width P and a reduced width at the second end 37. However, in this embodiment of FIG. 9, the width tapers to a minimum at a point 42 intermediate the ends 36 and 37. The distance from the first end 36 to the point 42 is 0.5 wavelengths at the cut-in frequency. From the point 42 to the second end 37 the antenna element has a constant width and u=0.75".

Figure 10A:
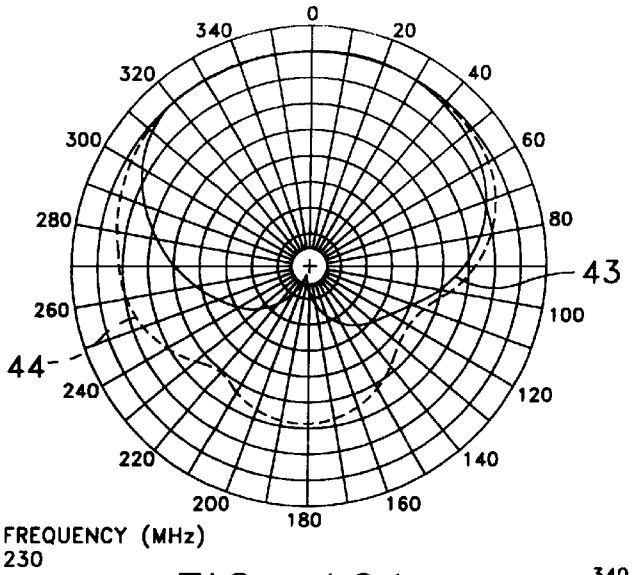
FIGS. 10A through 10C depict gain comparisons between the embodiment of FIGS. 8 and 9 and a standard antenna.
Figure 10B:
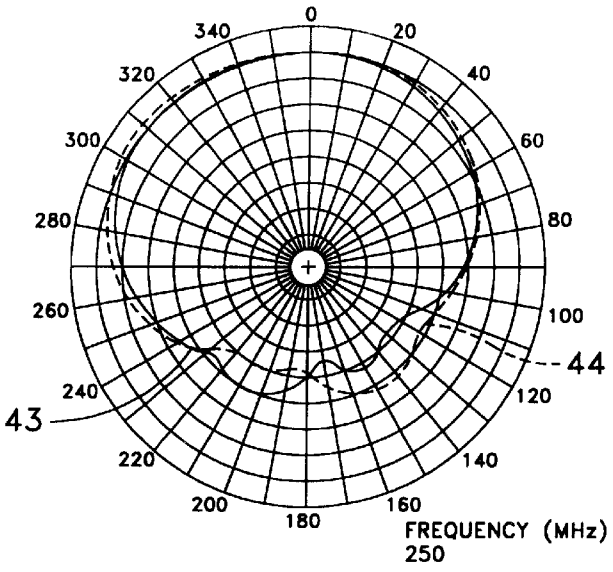
Figure 10C:
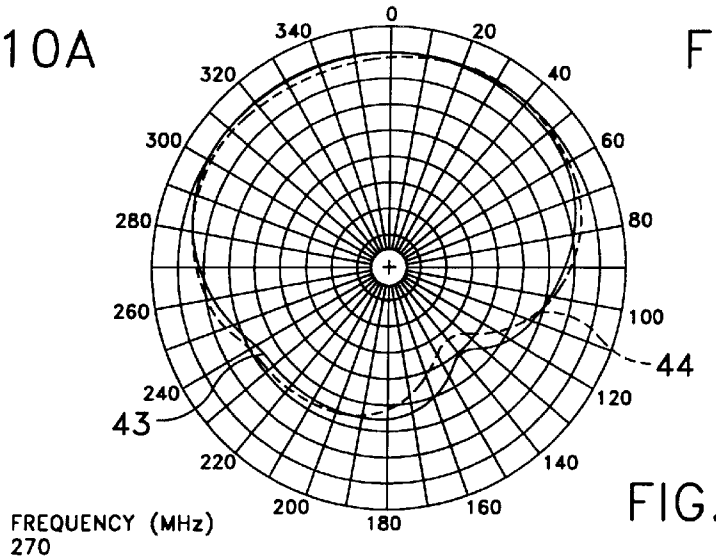

The graphical analysis in FIGS. 10A through 10C compares the cardioid patterns of the standard antenna (solid lines 43) and the antenna of FIGS. 8 and 9 (dashed lines 44) at operating frequencies of 230, 250 ad 270 MHz. In one area of FIG. 10A, the front-to-back ratio for the tapered version is not so high as that of the standard antenna. In FIG. 10B, however, the difference between the curves 43 and 44 reduces significantly. In FIG. 10C, at 270 MHz the two curves 43 and 44 are essentially identical. This essential curve identity continues up to an operating frequency of 340 MHz.

The basic difference between the two embodiments of FIGS. 1 and 8, as apparent, lies in the tapering configuration for each of the antenna elements, such as antenna elements 12 and 32. In the embodiment of FIG. 1, each of the antenna elements 12 through 15 tapers from the feed end 16 ($Z_o$= 100) to the second end 17 (of much higher $Z_o$) for a distance of one wavelength. This reduces the weight of the antenna elements by about 24%. With the embodiment of FIG. 9 each antenna element tapers down from a maximum width at the feed end 36 ($Z_o$=100) to an intermediate point 42 (of a much higher $Z_o$) and thereafter maintains a constant smaller width (and thus higher $Z_o$) to the unfed end 37. This provides an antenna that incorporates a minimum one-half wave matching section of transmission line on the antenna between the feed end 36 and the intermediate point 42 of 0.5 wavelengths. A weight reduction of about 56% is achieved with this embodiment. The gain values for both antennas constructed in accordance with this invention show little difference over the standard antenna even below the cut-in frequency. Consequently, either of the tapered structures in FIGS. 2 and 9 will reduce the amount of material that is otherwise be required in each antenna element. This reduction of material can significantly reduce the weight of the antenna below critical values. However, as shown by the various FIGS. 7A through 7C and 10A through 10C, this is accomplished without any significant degradation in the cardioid patterns provided over a broad band.

Therefore, in accordance with the various aspects and objects of this invention, tapering the individual antenna elements by any of a wide variety of different configurations, will enable the antenna elements themselves to provide both impedance matching along their lengths and weight reduction, thereby providing an antenna that is particularly well suited for satellite use, where weight becomes very critical. However, the antenna itself has a characteristic input impedance that closely matches those of conventional transmission lines and inherently matches the 100 ohms input impedance of 180 degree power splitters to the impedance of the antenna elements themselves. While this antenna has been depicted in terms of two specific tapering configurations, it will be apparent that a number of different variations could also be included other than the linear or partially linear structure shown in FIGS. 3 and 9. Consequently, it is the intent of the appended claims to cover all such variations and modifications as come under the true spirit and scope of this invention.

What is claimed is:

1. A helical antenna receiving an input rf signal from a source with a predetermined impedance, the antenna comprising:

a cylindrical support; and a given plurality of antenna elements wrapped on said cylindrical support as spaced helices along an antenna axis between first and second ends, each said antenna element having a maximum cross sectional area at said first end and a reduced cross sectional area at the second end whereby said antenna elements match the impedance at said first end of said antenna to the impedance of the source.

2. A helical antenna as recited in claim 1 wherein:

said given plurality of antenna elements is an even number; and said antenna elements terminate with free ends at their second ends.

3. A helical antenna as recited in claim 2 additionally comprising a connector for electrically connecting each pair of diametrically opposed free ends.

4. A helical antenna as recited in claim 1 wherein said maximum cross sectional area for all of said antenna elements lie at said first end.

5. A helical antenna as recited in claim 4 wherein said cross sectional area of each said antenna element tapers from said first end to said second end.

6. A helical antenna as recited in claim 4 wherein said cross sectional area of each of said antenna elements tapers linearly from said first end to said second end.

7. A helical antenna as recited in claim 4 wherein said cross sectional area of each of said antenna elements tapers from said first end to a position intermediate said first and second ends and is substantially constant between the intermediate position and said second end.

8. A helical antenna as recited in claim 7 wherein said intermediate position of each of said antenna elements is spaced from said first end by at least 0.5 wavelengths at the frequency of the input rf signal.

9. A helical antenna as recited in claim 1 wherein a width of each said antenna element tapers from said first end to said second end.

10. A helical antenna as recited in claim 1 wherein a width of said cross sectional area of each of said antenna elements tapers linearly from said first end to said second end.

11. A helical antenna as recited in claim 1 wherein a width of each of said antenna elements tapers from said first end to a position intermediate said first and second ends and is constant between the intermediate position and said second end.

12. A helical antenna as recited in claim 11 wherein said intermediate position of each of said antenna elements is spaced from said first end by at least 0.5 wavelengths at the frequency of the input rf signal.

13. A quadrifilar helical antenna for radiating an rf signal from a source with a predetermined impedance over a frequency bandwidth defined by a minimum operating frequency comprising:

a cylindrical support extending along an antenna axis between first and second ends thereof; and four equiangularly spaced helical antenna elements extending along said support between said first and second ends, each said antenna element having a length of at least ¾ wavelength at a minimum antenna operating frequency and having a cross sectional area of a constant thickness with a maximum width at said first end and a minimum width at said second end, said first ends of said antenna elements being coupled to the source whereby said antenna elements match the impedance of said antenna to the impedance of the source.

14. A quadrifilar helical antenna as recited in claim 13 wherein each of said antenna elements extends to a free end adjacent the second end of said cylindrical support.

15. A quadrifilar helical antenna as recited in claim 14 additionally comprising a connector for electrically connecting each pair of diametrically opposed free ends.

16. A quadrifilar helical antenna as recited in claim 13 wherein the width of each said antenna element tapers from said first end to said second end.

17. A quadrifilar helical antenna as recited in claim 13 wherein the width of said cross sectional area of each of said antenna elements tapers linearly from said first end to said second end.

18. A quadrifilar helical antenna as recited in claim 13 wherein the width of each of said antenna elements tapers from said first end to a position intermediate said first and second ends and is constant between the intermediate position and said second end.

19. A quadrifilar helical antenna as recited in claim 18 wherein said intermediate position of each of said antenna elements is spaced from said first end by at least 0.5 wavelengths at the frequency of the input rf signal.

* * * * *